US005413331A

United States Patent [19]

Stillinger

[11] Patent Number: 5,413,331

[45] Date of Patent: May 9, 1995

[54] SOFT REBOUNDABLE AMUSEMENT BALL AND OUTER SKIN MATERIAL

[75] Inventor: Scott H. Stillinger, Monte Sereno, Calif.

[73] Assignee: OddzOn Products, Inc., Campbell, Calif.

[21] Appl. No.: 994,290

[22] Filed: Dec. 21, 1992

[51] Int. Cl.[6] ..... A63B 41/08

[52] U.S. Cl. ..... 273/58 BA; 273/65 E

[58] Field of Search ..... 273/65, 58, 72 R

[56] References Cited

U.S. PATENT DOCUMENTS

| | | | |
|---|---|---|---|
| 712,412 | 10/1902 | Richards . | |
| 1,017,482 | 2/1912 | Turner et al. . | |
| 1,634,146 | 6/1927 | Henry | 273/58 BA |
| 2,011,760 | 8/1935 | Gallinant | 273/58 K |
| 2,761,684 | 9/1956 | Crowley et al. | 273/65 E |
| 3,070,479 | 12/1962 | Meyer . | |
| 3,119,618 | 1/1964 | Molitor | 273/65 E |
| 3,506,265 | 4/1970 | Yugi | 273/58 BA |
| 3,980,300 | 9/1976 | Hornsby, Jr. . | |
| 4,169,594 | 10/1979 | Crane . | |
| 4,333,648 | 6/1982 | Aoyama | 273/65 EB |
| 4,462,590 | 7/1984 | Mitchell | 273/65 E |
| 4,660,831 | 4/1987 | Kralik | 273/65 E |
| 4,717,158 | 1/1988 | Pennisi . | |
| 4,834,382 | 5/1989 | Spector . | |
| 4,917,381 | 4/1990 | Spector . | |
| 4,917,382 | 4/1990 | Hendershott | 273/72 R |
| 4,944,363 | 7/1990 | Osher et al. | 273/58 A |

FOREIGN PATENT DOCUMENTS 2929930 2/1981 Germany .

*Primary Examiner*—Mark S. Graham

*Attorney, Agent, or Firm*—Kolisch Hartwell Dickinson McCormack & Heuser

[57] ABSTRACT

An amusement ball is provided which has both a soft, pliable surface texture and good rebound characteristics. The ball has a resilient inner body at its core which is surrounded by at least one layer of foam. The foam imparts softness to the exterior of the ball. An outer layer of covering material surrounds the foam. The outer layer includes at least a portion of stretchable cloth fabric which allows the outer layer to stretch when the ball is rebounded. That reduces the loss of rebounding energy which would otherwise occur due to compression of the foam surrounding the core. As a result, the ball bounces higher and is generally more lively. An improved outer layer material for soft skin inflated balls is also disclosed. The skin is preferably a stretchable knitted fabric which stretches at least twenty-five percent (25%) in all directions in the plane of the fabric. The invention also includes an amusement ball having a specified thickness of polyurethane foam surrounding the core.

3 Claims, 1 Drawing Sheet

SOFT REBOUNDABLE AMUSEMENT BALL AND OUTER SKIN MATERIAL

BACKGROUND AND SUMMARY OF THE INVENTION

The invention relates generally to amusement devices and more particularly to an amusement ball and ball covering material for making balls which have both a soft pliable surface texture and good reboundability.

Inflated or air-filled balls are desirable amusement devices suitable for many activities. For example, a volleyball made by Aviva Sport, Inc. is made with an inner membrane shell in the form of an inflatable bladder surrounded by a very thin layer of foam material beneath a non-stretchable outer skin. The Aviva ball has good bounce, but it feels hard because the foam layer is so thin. Other inflated balls also have a hard feel.

Foam balls, on the other hand, have a soft feel. However, the foam absorbs a great deal of the energy imparted to the ball as it is bounced against the ground or other objects. Therefore, foam balls have limited bounce.

Thus, the trade-off in the design of balls has heretofore been between the softness of the ball and its reboundability. Foam balls tend to be comparatively "dead" and do not rebound as well as inflated, hard-skinned balls such as basketballs or the like.

It would be advantageous to have a soft amusement ball which offers the benefits of lightness and softness but which also is "lively" and reboundable, in comparison with prior art soft skin balls.

It would also be advantageous to have a soft skin ball which has a pleasing texture and feel and is inexpensive to produce.

Accordingly, the present invention provides an amusement ball with both a soft exterior and good rebound characteristics. The ball comprises a resilient inner body and at least one layer of foam surrounding the inner body for imparting softness to the exterior of the ball. An outer layer of covering material covers the ball. The outer layer includes at least a portion of stretchable cloth fabric whereby the outer layer stretches when the ball is rebounded to reduce the loss of rebounding energy which would otherwise occur due to compression of the foam surrounding the inner body.

In its preferred form, the invention employs stretchable cloth fabric in the outer covering material designed to accommodate at least twenty-five percent (25%) elongation of the fabric in all directions. A knitted fabric in which at least five percent (5%) of the fabric strands are elastic is suitable for that purpose. The outer covering material can be entirely formed of the stretchable cloth fabric or can incorporate as little as approximately twenty percent (20%) stretchable cloth fabric, with the remainder of the outer covering material being a substantially less stretchable material such as a conventional woven fabric. If less than the entire outer surface of the ball is covered with stretchable cloth fabric, it is preferred that regions of stretchable cloth fabric be distributed generally evenly around the ball, intermixed with other regions of substantially less stretchable sheet material such as nonstretchable fabric. The regions of stretchable cloth fabric and the less stretchable sheet material can be joined together by stitching or by a similar joining technique.

DETAILED DESCRIPTION OF THE PREFERRED EMBODIMENT

Figure 1:
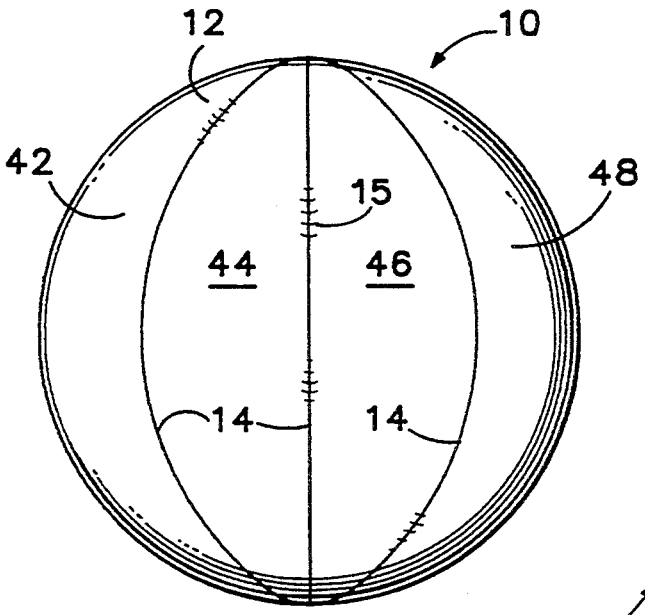
FIG. 1 is a partially schematic plan view of a reboundable amusement ball with a soft outer skin in accordance with the present invention.

FIG. 1 shows a perspective plan view of the exterior of an amusement ball in accordance with the present invention. Ball 10 is generally spherical and has an outer skin 12 made up of a plurality of panels separated by seam lines 14. The panels can all be identical material or can be of alternating colors or of alternating material types. Seams 14 include stitches 15 which join the panels to one another. The seams extend around the arc of ball 10 and can be provided in a variety of patterns, of which the illustrated example is only one. The panels can also be arranged in different patterns, for example, like a baseball or volleyball.

Figure 2:
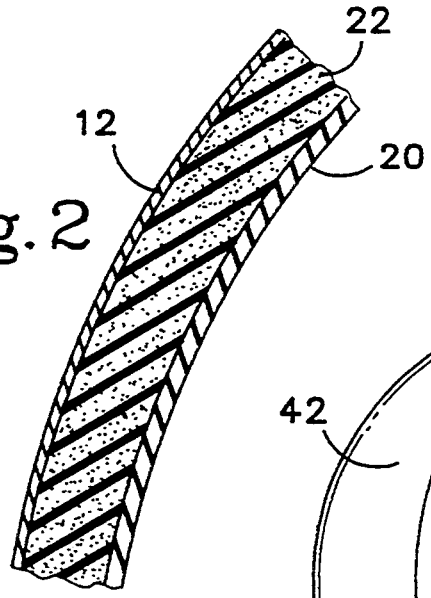
FIG. 2 is a partial cross-sectional segment of the ball of FIG. 1, greatly enlarged, showing the layers in the structure of the ball.

FIG. 2 is a partial cross-sectional segment of the outer wall of ball 10, illustrating its structure. The interior of ball 10 is an inflatable bladder or shell 20 made of an air-impervious resilient sheet material. An ideal material for bladder 20 is foamed polyvinylchloride (PVC) membrane material, which is a rubber-like substance. Bladder 20 is a continuous spherical envelope which has a conventional valve or similar opening (not shown) for admitting air or another inflating gas into the interior of the envelope. Bladder 20 will be filled with inflating gas and sealed prior to the use of the ball, as will be understood by those skilled in the art. Interior bladder 20 forms the resilient inner body of ball 10, serving as the internal base structure on which the other parts of the ball are installed.

Surrounding bladder 20 is at least one layer of foam 22 which is preferably a low-density polyurethane foam. In the illustrated embodiment, a single foam layer 22 serves as an intermediate or medial layer between bladder 20 and outer skin 12. The thickness of foam layer 22 is dependent on the desired softness of the outer skin and the size and weight of ball 10. A preferred thickness range for foam layer 22 is generally in the range of $\frac{3}{8}$-inch to 2-inches in thickness. On a prototype example of ball 10 which has a 15-inch outside diameter, foam layer 22 is approximately $\frac{1}{2}$-inch thick. To achieve a slightly softer outer skin texture, the thickness of foam layer 22 is increased. I believe that for the ball to remain reboundable or "bouncy" the thickness of foam layer 22 should not exceed approximately 2-inches.

The relatively thick foam layer creates a ball with a surprisingly soft feel and an attractive appearance. However, the foam is not so thick that it significantly limits the ball's bounce. The result is a new type of soft, bouncing ball, which is extremely fun to play with because it is both soft and bouncy.

The outer skin 12 of ball 10, also referred to as the outer layer of covering material, includes at least a portion of stretchable cloth fabric. The cloth fabric is preferably of a type which permits at least twenty-five percent (25%) elongation of the fabric in all directions. It has been found that the stretchable cloth fabric portion of the outer layer of covering material should encompass at least twenty percent (20%) of the surface area of the ball, in order to enhance the reboundability of the ball. Preferably, the stretchable cloth fabric will encompass fifty percent (50%) or more of the outer skin of the ball. In the illustrated embodiment, ball 10 has stretchable cloth fabric over the entire outer skin 12. The stretchable outer skin greatly enhances the reboundability of the ball, making it far livelier and more bouncy than an identical foam-clad ball covered with a nonstretchable skin.

The preferred cloth fabric for use as outer skin 12 is referred to generally as spandex, which is made of knitted fabric strands containing at least five percent (5%) elastic strands. An example of suitable spandex contains eighty-five percent (85%) nylon fabric strands and fifteen percent (15%) polyurethane fabric strands. Nylon strands are nonstretchable and polyurethane strands are very elastic and stretchable. When the nylon and polyurethane are combined in spandex, the result is a fabric which accommodates at least twenty-five percent (25%) elongation in all directions in the plane of the fabric without exceeding its elastic limit (i.e., without tearing or permanently deforming). By "stretchable in all directions" what is meant is that the fabric does not stretch appreciably further in one direction in its structure than in another. Preferably the fabric should accommodate at least fifty percent (50%) elongation. Tricot knitted spandex, which allows up to fifty percent (50%) elongation in any direction, is ideal for outer skin 12. Circular-knitted fabric is also suitable for skin 12. Other types of stretchable cloth fabrics which permit approximately twenty-five percent (25%) elongation or more in any direction could also be used for the stretchable portion of outer skin 12.

Figure 3:
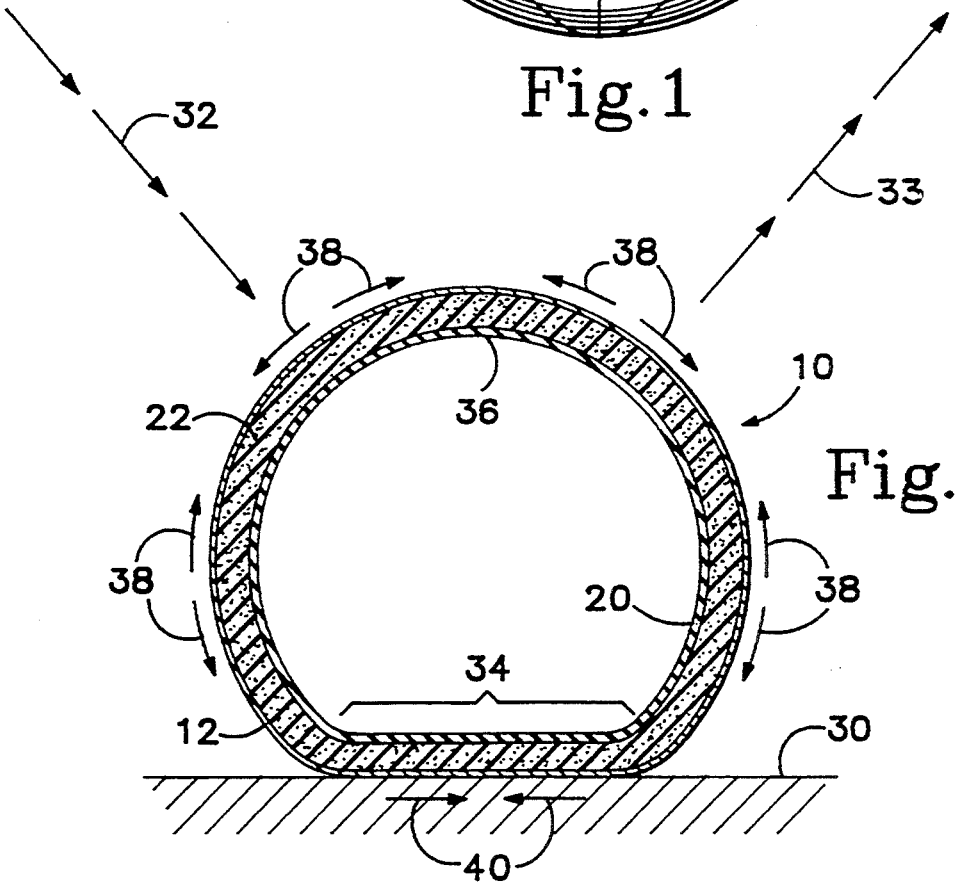
FIG. 3 is a partially schematic cross-sectional view of the ball of FIG. 1 illustrating how the ball and its component layers deform and stretch when the ball impacts against the ground or another hard surface as it is bounced.

FIG. 3 illustrates the ball 10 impacting the ground 30. The ball is directed at the ground along arrows 32 and is shown at the instant of maximum compression of the ball before it rebounds in the direction of arrows 33. What follows is an explanation of the inventor's theory about why soft skin balls made with the outer skin of the present invention have substantially improved reboundability and liveliness. The ball 10 shown in FIG. 3 is illustrated in cross section. The ball strikes the ground 30, causing a portion 34 of its periphery to become flattened. The impact deforms soft outer skin 12 and foam layer 22, causing bladder 20 to become flattened in region 34. Since the hollow interior 36 of ball 10 is sealed and filled with air (i.e., it is pressurized), the compression of one area of bladder 20 increases the internal pressure within the bladder, causing a slight expansion of the bladder everywhere except along flattened portion 34. At the same time foam layer 22 may be compressed slightly in region 34 and stretched in other places around bladder 20, but the foam layer will generally maintain its shape and thickness as the ball strikes the ground. The expanse of covering material which forms outer skin 12 is stretched slightly everywhere except in flattened region 34, as indicated generally by arrows 38, which are intended to schematically illustrate the stretching or the tightening of the cloth fabric of skin 12. Some contraction of skin 12 may simultaneously take place in the flattened region 34, as indicated schematically by arrows 40.

The advantage derived from presence of stretchable outer skin 12 is that it allows the skin to act in the manner of a balloon, or like the skin of a rubber ball or other bouncing-type ball. In other words, skin 12 stretches as inner bladder 20 stretches. Prior art inflated balls with nonstretchable outer skins do not react in the manner shown in FIG. 3 when the ball is thrown against the ground. Without stretchable skin, the expansion of the skin indicated by arrows 38 does not occur in prior art balls. Consequently, when the bladder stretches outwardly in prior art balls, the bladder partially compresses the foam layer against the nonstretchable outer skin. As a consequence, the foam layer absorbs a great deal of the kinetic energy of the ball. Lowdensity polyurethane foam is highly "deadening."

In the present invention, the kinetic energy of the ball is transferred through the foam layer 22 to compress inner bladder 20, briefly stretching the bladder outwardly and causing a responsive stretching of the foam layer and outer skin, after which the bladder quickly retracts and reestablishes the original shape of the ball, producing a rebound. The inventor believes that very little compression of foam layer 22 occurs. Only in the region 34 immediately adjacent the impact area is there any appreciable foam layer compression.

The inventor, through extensive experimentation, has found that a stretchable fabric covering on a foam-clad inflated ball increases the rebound height of the ball, and usually multiplies the rebound height by twenty-five percent (25%) or more. That represents a substantial improvement in the reboundability of the ball. The invention also enhances the overall softness of the ball by providing a thicker foam layer. The Aviva volleyball discussed earlier has a foam layer which is approximately ⅛-inch thick. The ball of the present invention, on the other hand, provides a layer of polyurethane foam generally in the range of ⅜-inch to 2-inches thick surrounding the core.

The invention does not require that the entire surface of the ball be covered with a stretchable cloth fabric skin, as mentioned above. Returning to FIG. 1, it has been found that use of alternating panels of stretchable and nonstretchable cloth fabric gives the ball the benefits of the present invention at reduced cost. For example, in FIG. 1, the illustrated fabric panels are 42, 44, 46, 48. If panels 42 and 46 are made of stretchable cloth fabric in accordance with the present invention, panels 44 and 48 could be made of a sheet material which is substantially less stretchable than the cloth fabric. An example of a sheet material suitable for panels 44, 48 is nonstretchable nylon fabric.

The panels 42, 44, 46, 48 shown in FIG. 1 are longitudinally separated by seams 14 which are generally equally spaced around the circumference of the ball. It would be possible to reduce the size or width of stretchable panels 42 and 46, and increase the width of nonstretchable panels 44 and 48 and still achieve the benefits of the present invention. The inventor believes that a ball with an outer skin which includes at least twenty percent (20%) by area of stretchable cloth fabric will greatly benefit from the present invention. Other patterns of seam lines 14 can also be used with the present invention. The principle requirement is that the regions of stretchable cloth fabric be distributed generally evenly around the ball so that the overall surface area of outer skin 12 is generally stretchable.

Alternative embodiments are possible within the scope of the present invention. For example, balls having alternative shapes from the spherical ball shown in the figures could incorporate the invention. Oblong or football-shaped balls could be used with the stretchable outer skin, as will be understood by those skilled in the art. A solid inner core of resilient material could be substituted for bladder 20, or the inner body in the ball could be made of a thick shell of resilient rubber or the like which is not inflatable. Additional layers of foam or other materials could be included in the ball structure. Other variations are possible within the scope of the invention, as defined in the following claims.

I claim:

1. An amusement ball comprising:

a resilient inner body;

a layer of foam surrounding the inner body; and an expanse of material surrounding the intermediate layer and constituting an exterior surface of the ball, where the material comprises a stretchable area of fabric joined with a substantially less stretchable area of fabric, with the substantially less stretchable area constituting a portion of the exterior surface.

2. An amusement ball as in claim 1 in which the stretchable area of fabric and the substantially less stretchable area of fabric are joined together by stitching.

3. A reboundable amusement ball comprising:

a spherical, bounceable, resilient inner bladder defined by a stretchable membrane, where the stretchable membrane allows the inner bladder to be deformable;

a layer of foam having a thickness of $\frac{3}{8}$-inch to 2-inches surrounding the inner bladder for imparting softness to the ball while allowing the bladder to remain bounceable; and a layer of material covering the layer of foam and constituting an exterior surface of the ball, the material including at least a portion of stretchable fabric to reduce energy absorption by the foam when the ball is bounced by allowing the exterior surface to expand or contract when the inner bladder is deformed, thus improving the bounceability of the ball, and the material also including a less stretchable area of fabric, with the less strechable area constituting a portion of the exterior surface.

* * * * *